US012473056B2

(12) United States Patent
Lee et al.

(10) Patent No.: US 12,473,056 B2
(45) Date of Patent: Nov. 18, 2025

(54) INFLATABLE KAYAK

(71) Applicant: Northwest River Supplies, Inc., Moscow, ID (US)

(72) Inventors: HeeJae Lee, Incheon (KR); Lee Young Lim, Incheon (KR)

(73) Assignee: Northwest River Supplies, Inc., Moscow, ID (US)

( * ) Notice: Subject to any disclaimer, the term of this patent is extended or adjusted under 35 U.S.C. 154(b) by 426 days.

(21) Appl. No.: 18/196,234

(22) Filed: May 11, 2023

(65) Prior Publication Data

US 2023/0365237 A1 Nov. 16, 2023

Related U.S. Application Data

(60) Provisional application No. 63/340,765, filed on May 11, 2022.

(51) Int. Cl.
*B63B 34/22* (2020.01)

(52) U.S. Cl.
CPC ..... *B63B 34/22* (2020.02); *B63B 2221/10* (2013.01); *B63B 2221/18* (2013.01)

(58) Field of Classification Search
CPC .. B63B 34/22; B63B 2221/10; B63B 2221/18
See application file for complete search history.

(56) References Cited

U.S. PATENT DOCUMENTS

| | | | | |
|---|---|---|---|---|
| 2009/0078186 | A1* | 3/2009 | Rista | B63B 34/22 114/345 |
| 2014/0251195 | A1* | 9/2014 | Excoffon | B63B 7/082 114/345 |
| 2017/0008602 | A1* | 1/2017 | Hoge, Jr. | B63B 34/22 |
| 2021/0354785 | A1* | 11/2021 | Prade | B63B 34/22 |
| 2022/0242530 | A1* | 8/2022 | Cooper | B63B 34/26 |

* cited by examiner

*Primary Examiner* — Evan P Dzierzynski
(74) *Attorney, Agent, or Firm* — Duncan Palmatier

(57) ABSTRACT

An inflatable kayak constructed of drop-stitch material. When inflated, the drop-stitch members form a rigid, planar structure. To form a non-planar contour in one of the surfaces of a drop-stitch member, the opposing surface is folded over onto itself and a strip of glue along the fold adheres the opposing surface along the glue strip, thereby forming a V-fold extending into the interior of the drop-stitch member. When the member is inflated, the V-fold will alter the profile of the opposing surface and cause the first surface to project away along that profile. The V-fold can be augmented by use of a V-tape or contour member within the V-fold. Using a contour member in the V-fold creates profiles that a fold alone cannot produce.

12 Claims, 8 Drawing Sheets

Fig. 10A (Prior Art)
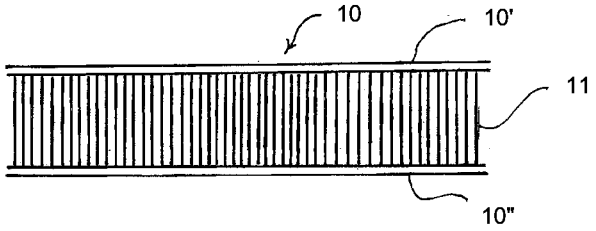
Fig. 10B (Prior Art)
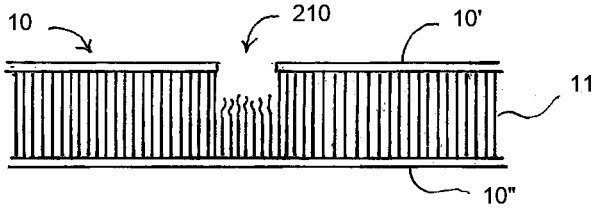
Fig. 10C (Prior Art)
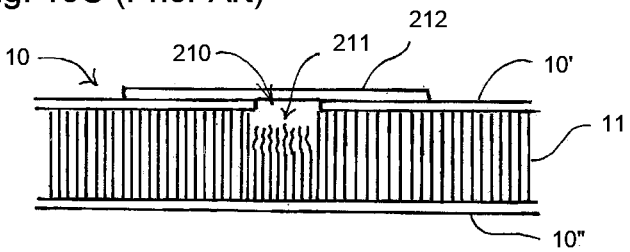
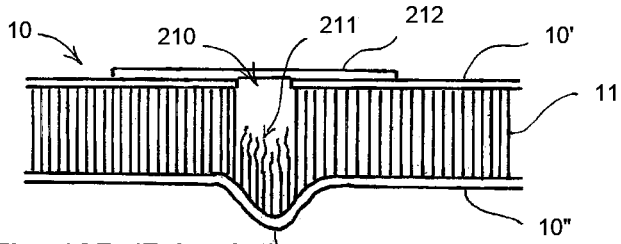
Fig. 10D (Prior Art)

Fig. 11A
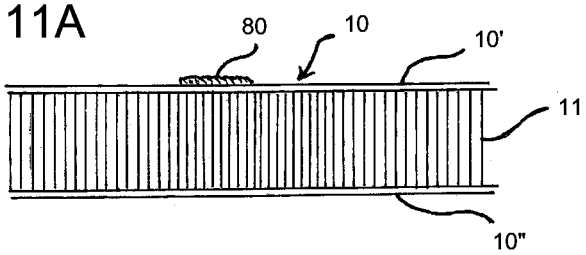
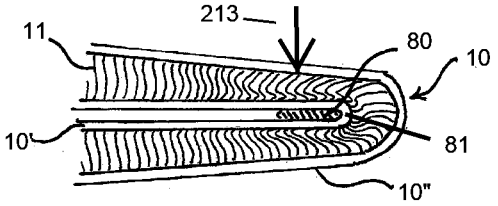
Fig. 11B
Fig. 11C
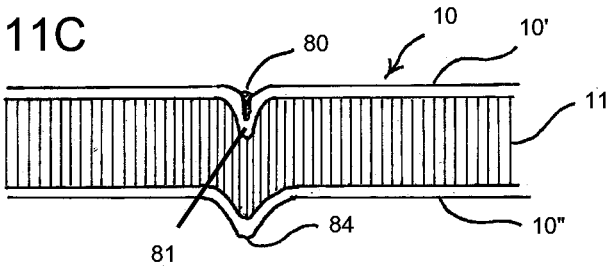
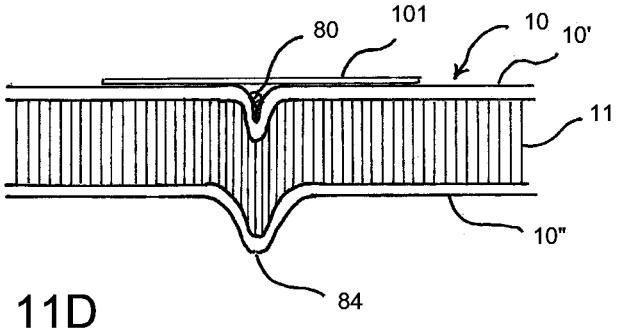
Fig. 11D

Fig. 12A
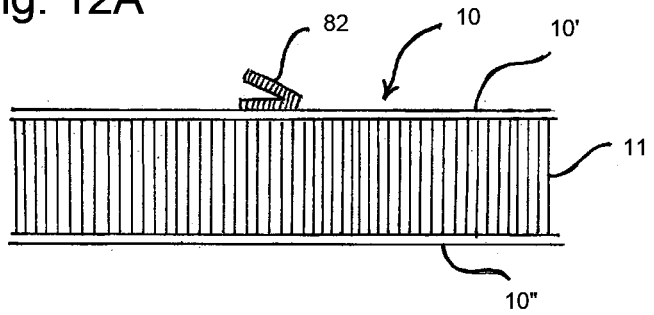
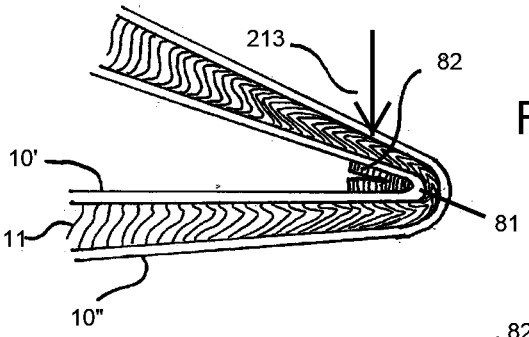
Fig. 12B
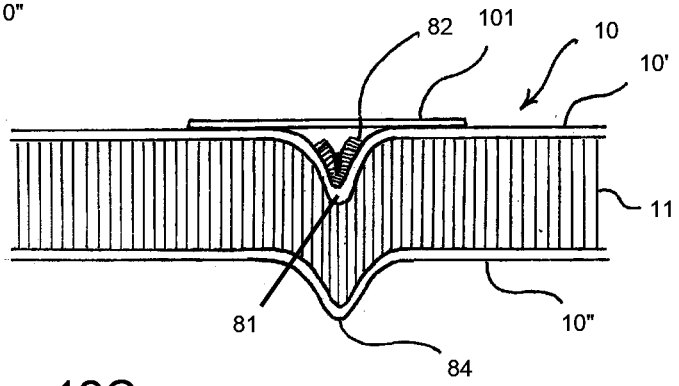
Fig. 12C

INFLATABLE KAYAK

CLAIM OF PRIORITY TO PROVISIONAL APPLICATION (35 U.S.C. § 119(e))

This application claims priority under 35 U.S.C. § 119(e) from provisional patent Application No. 63/340,765, filed May 11, 2022. The 63/340,765 application is incorporated herein by reference.

BACKGROUND OF THE INVENTION

1. Field of the Invention

This invention relates to inflatable kayaks. More specifically, the disclosed inflatable kayak is characterized by inflatable bottom and side members joined by flexible side surfaces and V-tapes that, when inflated, form a smooth kayak profile. The invention further discloses a construction and process for forming non-planar surface features in an inflatable drop-stitch member by use a V-fold or V-tape structures.

2. Background of the Invention

Referring to FIGS. 10A through 10D, the current method of forming non-planar contours in an inflatable drop-stitch member 10, such as a keel 84 in a drop-stitch inflatable kayak, involves a process of detaching the drop-stitch threads 11 from one interior surface of the member 10, then allowing the opposite surface to bulge out when the member 10 is inflated. To form a keel 84, for example, a slit or slice of material 210 is cut along a longitudinal center line of the upper surface 10' of a drop-stitch board member 10, thereby detaching the drop-stitch threads/fibers 11 from the upper surface 10' along that longitudinal center line of the member 10. The drop-stitch fibers 11 secured to the bottom surface 10" of the member 10 are thereby disconnected 211 from the top surface 10' along the slit 210. A strip of air-tight material 212 is then glued over the slit 212 to restore air-tightness to the drop-stitch inflatable member 10. When inflated, the released fibers 211 will not hold the bottom surface 10" of the member 10 at a fixed distance from the top surface 10', thereby causing the bottom surface 10" to bulge down along the longitudinal center line and form a keel 84.

Among the disadvantages of this method is that it requires cutting the slit 210 in the drop-stitch member 10 and thereby destroys the material's structural integrity. As described above, this requires gluing a patch piece 212 over the slit 210 along the top surface 10' of the inflatable member 10. Such a patch 212 establishes a weak point in the member's 10 air-tight structure. Moreover, the process of making the slit 210 and cutting the drop-stitch threads 11 requires very careful and time-consuming manual labor. Also, while cutting the drop-stitch threads 11 will allow cause the opposing surface to bulge out when the member 10 is inflated, the shape of the bulge cannot be contoured, since the threads 11 are a fixed length and will be detached only along the area where they were cut. Finally, the threads 11 adjacent the slice 210 will be subjected to strain along the bulge in the bottom 10" of the inflated member 10. What is needed is a method that will form a non-planar contour in a drop-stitch member 10, such as a keel 84, without cutting through the top 10' or bottom 10" surfaces and destroying the member's integrity.

SUMMARY OF THE INVENTION

The present invention is an inflatable kayak constructed of drop-stitch material, comprising an inflatable bottom member and a pair of inflatable side members joined to the bottom member by, flexible sides and V-tapes that allow the side members to form smooth sides that angle up to form a traditional kayak profile. When inflated, the drop-stitch members form a rigid structure. To form a non-planar contour in one of the surfaces of a drop-stitch member, the opposing surface is folded over onto itself and a strip of glue along the fold adheres the opposing surface along the glue strip, thereby forming a V-fold extending into the interior of the drop-stitch member. When the member is inflated, the V-fold will alter the profile of the opposing surface and cause the first surface to project away along that profile. The V-fold can be augmented by use of a V-tape within the V-fold. Using a V-tape can shape the V-fold to create profiles that a fold alone cannot produce. On top of the opposing surface a covering can be glued to provide lateral stability to prevent the V-fold from pulling apart.

DESCRIPTION OF THE DRAWINGS

FIGS. 10A through 10D show cross sections of an inflatable drop-stitch member and the steps of the prior art process of forming a keel in an inflatable stand-up kayak by cutting a slit through the top surface of the member.

FIGS. 11A through 11D show cross sections of an inflatable drop-stitch member and the construction and steps of a process of forming a non-planar surface by the V-fold construction of the present invention.

FIGS. 12A through 12C show cross sections of an inflatable drop-stitch member forming a non-planar surface by the V-tape construction of the present invention.

DETAILED DESCRIPTION OF THE PREFERRED EMBODIMENTS

Figure 1:
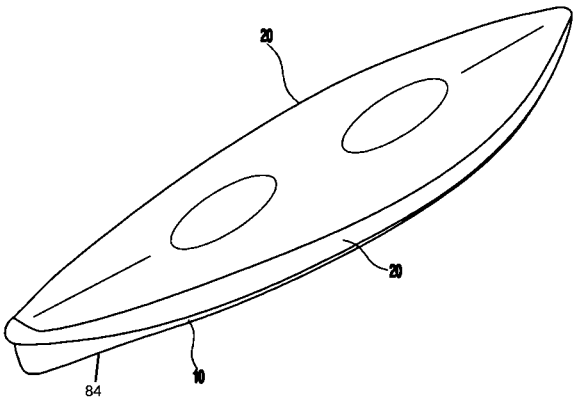
FIG. 1 is a three-quarter view of an inflatable stand-up kayak as seen from the rear three-quarter view.
Figure 2:
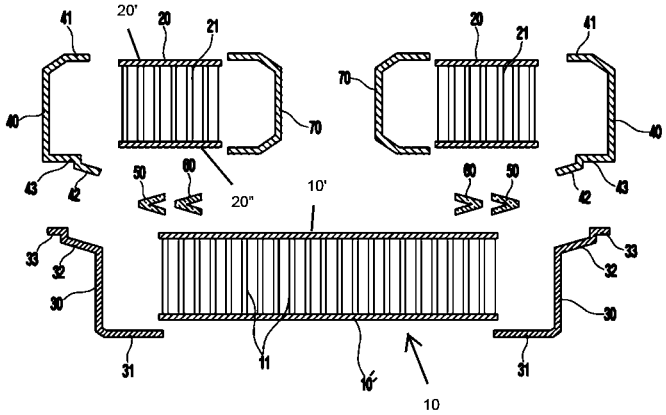
FIG. 2 is an exploded cross section view of the parts of the inflatable kayak.
Figure 3:
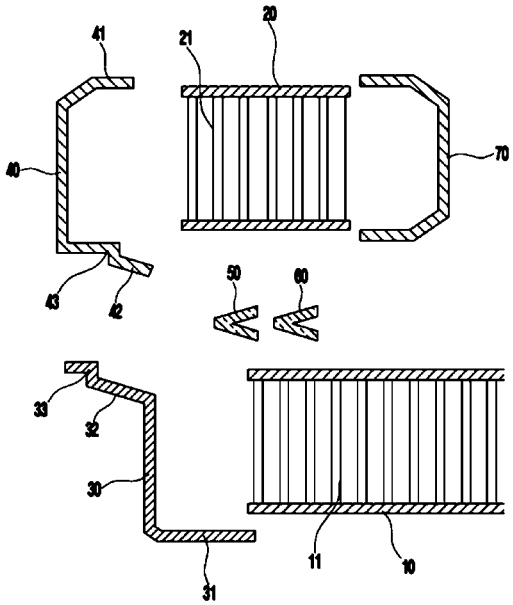
FIG. 3 is an enlarged, exploded cross section view of portions of the inflatable kayak.

FIGS. 1 through 5 show one embodiment of inflatable kayak of the present invention. FIG. 1 shows an inflatable kayak formed by an inflatable bottom member or tube 10, a keel 84 extending down from the bottom member 10, and side members or tubes 20 running along the length of the bottom tube 10, FIG. 2 shows an exploded cross section of the parts making up the bottom 10 and side 20 tubes. Bottom tube 10 has top or first 10' and bottom or second 10" surfaces formed of airtight material. As shown in FIG. 2, the bottom tube 10 has open sides, but, when the sides are closed an airtight structure is created that can be inflated. Between the top 10' and bottom 10" surfaces of the bottom tube 10 are a plurality of shape retention lines or threads 11 that retain the top 10' and bottom 10" surfaces at a fixed distance from each other under inflation. While the drawings show a few of these threads 11, persons of skill in the art will recognize that these are representative of many thousands of such threads. This construction is referred to as "drop-stitch", which is flexible and compact when deflated, but rigid and strong when inflated. Conventionally, the drop-stitch member 10 will have threads 11 of equal lengths that hold the top surface 10' and the bottom surface 10" at an uniform fixed distance from each other. Persons of skill in the art will appreciate that it is possible, although difficult to make a drop-stitch member with threads of different lengths to, for example, bring the top and bottom surfaces closer to each other with shorter threads in order to form a thinning nose. However, such construction still results in a member with planar top and bottom surfaces. For the purposes of this disclosure, when the applicant states that drop-stitch threads hold a first surface at a fixed distance from an opposed second surface, applicant intends to include constructions with planar surfaces, even if the distance between such planar surfaces changes. A pair of bottom tube 10 side surfaces or tapes 30 are placed symmetrically to cover both open sides of the bottom tube 10. A lower-end attachment section 31 of the side tapes 30 is joined to the lower bottom surface 10" of the bottom tube 10. Each side tape 30 has a first inclined attachment section 32 inclined outward at the upper corner as well as a first bent attachment section 33 where the upper end of the first inclined attachment section 32 is symmetrically formed by bending L shapes.

Figure 5:
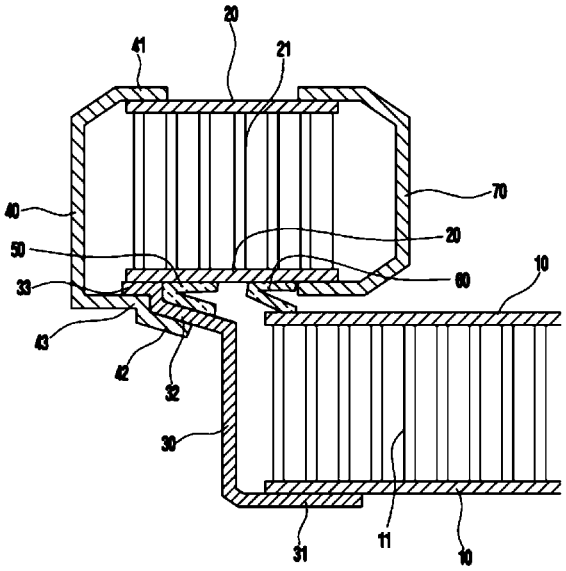
FIG. 5 is an enlarged cross section view of a portion of the inflatable kayak.

Each of the pair of side members or tubes 20 has an upper 20' and lower 20" surface and is open at each side. A pair of inner seal tapes 70 are symmetrically attached to the upper 20' and lower 20" surfaces of the inner-directed openings of the side tubes 20 and create an airtight seal. Side member 20 upper side tapes 40 are placed symmetrically to cover outer open sides of each side tube 20. An upper-end attachment section 41 formed at the upper end of the upper side tape 40 is attached to the upper surface 20' of the side tube 20. A lower-end second inclined portion 42 of the upper side tape 40 is formed to be inclined toward the inside of the structure so as to connect with the lower surface of the first inclined portion 32. As with the drop-stitch construction in the bottom tube 10, between the top 20' and bottom 20" surfaces of the side tubes 20 are many shape retention lines or threads 21 that retain the top 20' and bottom 20" surfaces at a fixed distance from each other under inflation. As shown in FIG. 5, the upper surface of the first bent attachment section 33 is joined to the lower surface 20" of the side member 20. A second bent attachment section 43 is formed symmetrically while bending in an L shape at the upper end of the second inclined attachment section 42. The upper surface of the first bent attachment section 33 is joined to the outer edge of the lower surface 20" of the side tube 20. The upper surface of the second bent attachment section 43 is attached to the lower surface of the first bent attachment section 33 and the upper surface of the second inclined attachment section 42 is attached to the lower surface of the first inclined attachment section 32. The lower surface of each of a pair of first V-tapes 50 joins the upper surface of the first inclined attachment sections 32, and the upper surface of each of the pair of first V-tapes 50 joins to the lower surface 20" of the side tubes 20. Similarly, the lower surfaces of each of the pair of second V-tapes 60 joins the upper surface 10' of the bottom tube 10, and the upper surface of each of the pair of second V-tapes 60 joins to the lower surface 20" of the side tube 20.

Figure 4:
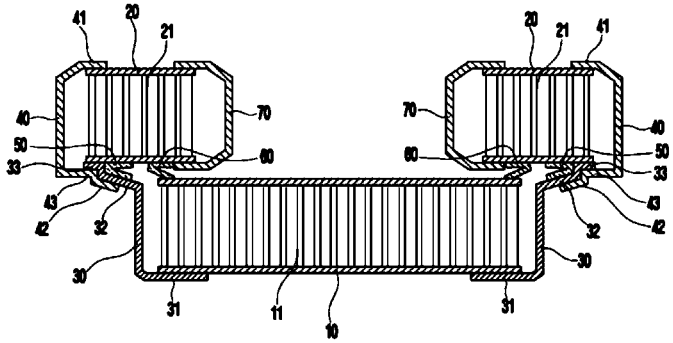
FIG. 4 is a cross section view of the members of the inflatable kayak.
Figure 6:
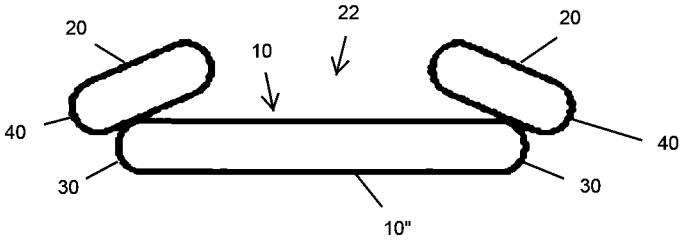
FIG. 6 is a cross-section of the inflatable kayak when inflated.

As seen in FIGS. 4 and 6, when inflated, the arrangement of the first and second V-tapes, 50 and 60, will force the inner seal tape 70 ends of the side tubes 20 upward from the top surface 10' of the bottom tube 10, thereby creating an inner cockpit of a kayak 22.

Figure 7:
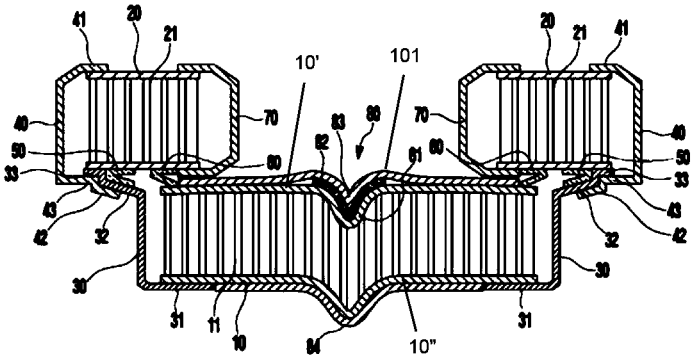
FIG. 7 is a cross section view of the members of the inflatable kayak with the V-tape of the present invention.
Figure 8:
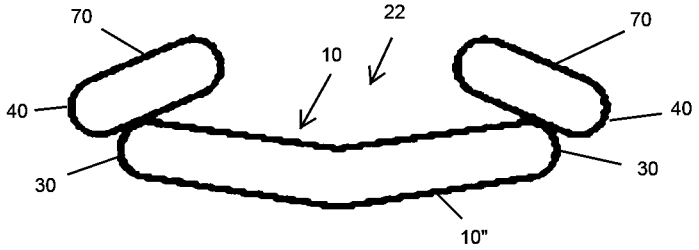
FIG. 8 is a cross-section of the inflatable kayak when inflated.
Figure 9:
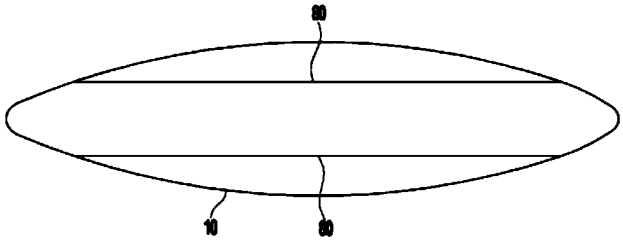
FIG. 9 is a view of the bottom of the inflatable kayak.

Referring to FIGS. 7 and 8, an alternative embodiment of the invention is disclosed with the bottom tube 10 including a downwardly convex section 84 along a longitudinal direction in the middle of the bottom surface 10" of the bottom tube 10 and a corresponding concave section 83 along a longitudinal section 80 in the middle of the top surface 10'. The convex section may form a rail or keel 84, which helps the bottom tube 10 run straight in the water. The convex section 84 is formed in the drop-stitch 11 bottom tube 10 by forcing down the top surface 10' with a third V-tape or contour member 82. The third V-tape 82 creates a folded part 81 in the top surface 10', which, owing to the drop-stitch shape retention lines 11, in turn forces down the bottom surface 10". In a further embodiment, shown in FIG. 9, more than one straight concave section 80 can be formed in the top surface 10' of the bottom tube 10 to create multiple longitudinal straight convex sections or keels 84 in the bottom surface 10".

Referring to FIGS. 11A through 11F, the construction and process of the invention allows the creation of a non-planar surface in a drop stitch member 10, such as a keel 84 in the bottom surface 10", without cutting a slit in the top surface 10' of the bottom tube member 10. To create the longitudinal keel 84, the top surface 10' of the bottom tube member 10 is folded over onto itself along a longitudinal section aligned with the line of a keel 84. A strip of glue 80 is placed along the longitudinal center line. The top surface 10' of the member 10 is folded over onto itself along the longitudinal section aligned with the line of a keel 84. The glue strip 80 adheres the top surface 10' and forms a folded part 81. The top surface 10' is pressed down, as indicated by arrow 213, to establish folded part 81 in the top surface 10' along the longitudinal center line. As shown in FIG. 11C, the glue strip 80 forms a permanent bond along the folded part 81. As shown in FIG. 11D, the folded part 81 in the top surface 10' created by the glue strip 80 establishes the permanent concave folded part or V-fold 81 in the top surface 10'. When the member 10 is finished and made air-tight, inflation will cause the drop stitch 11 fibers between the concave V-fold 81 and the convex straight section 84 to go into tension and, thereby, the crease created by the V-fold 81 forces the bottom surface 10" of the member 10 to bulge down along the longitudinal section V-fold 81, forming a keel 84 in the bottom surface 10" of the member 10. In a preferred embodiment, shown in FIG. 11D, a top covering 101 is adhered to the top surface 10' of the tube member 10. The top covering 101 provides lateral strength to prevent the glued strip 80 from pulling apart when the member 10 is inflated.

FIGS. 7 and 12A through 12D show the use of the V-tape or contour member 82 construction and process to establish a corresponding contour, such as a keel or rail 84, projecting from the opposing surface. The top surface 10' of the bottom tube member 10 is folded over onto itself along a longitudinal section aligned with the line of a keel 84. A V-tape 82 is glued to the top surface 10' along the longitudinal center line 80. Glue is also placed on the exterior surfaces of the V-tape 82 and the top surface 10' of the member 10 is folded over onto itself along the longitudinal section aligned with the line of a keel 84. The glue on the exterior of the V-tape 82 adheres the top surface 10' to the V-tape 82 and forms a folded part 81. The top surface 10' is pressed down, as indicated by arrow 213, to establish folded part 81 in the top surface 10' along the longitudinal center line. The folded part 81 in the top surface 10' created by the V-tape 82 establishes the permanent concave folded part 81 in the top surface 10'. When the member 10 is finished and made air-tight, inflation will cause the drop stitch 11 fibers between the concave folded part 81 and the convex straight section 84 to go into tension and, thereby, the crease created by the folded part 81 forces the bottom surface 10" of the member 10 to bulge down along the longitudinal section folded part 81, forming a keel 84 in the bottom surface 10" of the member 10. In a preferred embodiment, shown in FIG. 12C, a top covering 101 is adhered to the top surface 10' of the tube member 10. The top covering 101 provides lateral strength to prevent the folded part 81 from pulling apart when the member 10 is inflated. It will be appreciated by those skilled in the art, that the use of the V-tape 82 allows for flexibility in contouring the shape of the folded part 81 in ways that the V-fold 81 shown and described in connection with FIGS. 11A through 11D, may not permit. For example, the V-tape or contour member 82 could be formed of a stiff material that will force down the top surface 10' to form wider or more varied contours.

According to the principles disclosed and shown in FIGS. 11A through 11D, an inflatable drop-stitch structure, such as a kayak, board, raft or like, can be made having non-planar surface contours formed in a drop-stitch member 10 comprising a first surface 10' having a first outward facing side and a first inward facing side and a second surface 10' having a second inward facing side and a second outward facing side, wherein the first inward facing side of the first surface 10' and second inward facing side of the second surface 10" are opposed to each other. The drop-stitch member 10 further comprises a plurality of threads 11 joined to the first surface 10' at a proximal thread end and joined to the second surface 10" at a distal thread end, wherein the plurality of threads 11 holds the first surface 10' at a fixed distance from the second surface 10" when inflated. The first surface 10' further comprises a V-fold 81 comprising a first V-fold segment of the first outward facing side held adjacent to a second V-fold segment of the first outward facing side. The V-fold 81 extends from the first inward facing side of the first surface 10 in a V-fold direction toward the second inward facing side of the second surface 10". The second surface 10" forms a complimentary contour 84 to the V-fold 81 and the complimentary contour 84 extends from the second outward facing side of the second surface 10" when the drop-stitch member 10 is inflated and the plurality of threads 11 are in tension. The inflatable drop-stitch structure 10 having a non-planar surface contour may further comprise a top covering 101 fixed over the V-fold 81, wherein the top covering 101 assists in holding the first V-fold 81 segment adjacent to the second V-fold segment. As shown in FIGS. 12A through 12C, the inflatable drop-stitch structure 10 having a non-planar surface contour may further comprise a contour member 82 in the V-fold 81 between the first V-fold segment and the adjacent V-fold segment. The contour member 82 may have a contour profile directed toward the second inward facing side of the second surface 10", and the contour profile will form a complimentary profile in the complimentary contour 84 of the second surface 10". A top covering 101 may be fixed over the V-fold 81 and contour member 82. The top covering 101 assists in holding the first V-fold segment of the V-fold 81, contour member 82, and second V-fold segment of the V-fold 81 together. According to the principles disclosed, the inflatable drop-stitch structure 10 having a non-planar surface contour, such as shown in FIG. 1, may form a front end and a rear end and a longitudinal axis 84 between the front end and rear end, such that the V-fold 81 in the first surface 10' and the complimentary contour of the second surface 10" forms a keel 84 extending from the second outward surface along the longitudinal axis when the drop-stitch member is inflated and the plurality of threads 11 are in tension.

The disclosed invention encompasses a process for forming a non-planar surface contour in an inflatable drop-stitch structure 10, comprising the steps of providing a drop-stitch member 10 comprising a first surface 10' having a first outward facing side and a first inward facing side, a second surface 10" having a second outward facing side and a second inward facing side, wherein the first inward facing side of the first surface 10' and second inward facing side of the second surface 10" are opposed to each other. A plurality of threads 11 join the first inward facing side of the first surface 10' at a proximal thread end and the second inward facing side of the second surface 10" at a distal thread end. The plurality of threads 11 hold the first surface 10' at a fixed distance from the opposed second surface 10" when the member 10 is inflated. Referring again to FIGS. 11A through 11D, a glue strip is applied to a glued portion 80 of the outward facing side of the first surface 10'. The first outward facing side of the first surface 10' is folded over and onto the first outward facing side of the second surface 10" along the glue strip 80 and the glue strip 80 adheres the first outward facing side of the first surface 10' along the glued portion 80, forming a V-fold 80 in the first surface 10'. The V-fold 80 extends from the first inward facing side of the first surface 10' toward the second inward facing side of the second surface 10". A top covering 101 may be adhered on the first outward facing side of the first surface 10' over the glued portion 80 of the V-fold 81. Referring to FIGS. 12A through 12C, the process for forming a non-planar surface contour in an inflatable drop-stitch structure 10 may further comprise the steps of providing a contour member 82 having a contour profile and placing the contour member 82 in the glued portion of the V-fold 81, such that the contour profile of the contour member 82 is directed toward the second inward facing side of the second surface 10". A top covering 101 may be adhered on the first outward facing side of the first surface 10' over the glued portion of the V-fold 81. The top covering 101 assists in holding the glued portion of the V-fold 81 and contour member 82 together. The contour member 82 may have a contour profile that causes a complimentary contour profile 84 to form on the second outward facing surface of the second surface 10" when the drop-stitch member is inflated.

The drawings and description set forth here represent only some embodiments of the invention. After considering these, skilled persons will understand that there are many ways to make an inflatable drop-stitch structure according to the principles disclosed. The inventor contemplates that the use of alternative structures, materials, or manufacturing techniques, which result in an inflatable drop-stitch structure according to the principles disclosed, will be within the scope of the invention.

The invention claimed is:

1. An inflatable drop-stitch structure having a non-planar surface contour comprising:

a. a drop-stitch member comprising a first surface having a first outward facing side and a first inward facing side, a second surface having a second outward facing side and a second inward facing side, wherein the first inward facing side and second inward facing side are opposed to each other, wherein the drop-stitch member further comprises a plurality of threads joined to the first inward facing side at a proximal thread end and joined to the second inward facing side at a distal thread end, wherein the plurality of threads holds the first surface at a fixed distance from the second surface when inflated;

b. wherein the first surface further comprises a V-fold comprising a first V-fold segment of the first outward facing side held adjacent to a second V-fold segment of the first outward facing side, and wherein the V-fold extends from the first inward facing side in a V-fold direction toward the second inward facing side; and c. wherein the second surface forms a complimentary contour to the V-fold and the complimentary contour extends from the second outward facing side when the drop-stitch member is inflated and the plurality of threads are in tension.

2. The inflatable drop-stitch structure having a non-planar surface contour of claim 1, further comprising a top covering fixed over the V-fold, wherein the top covering assists in holding the first V-fold segment adjacent to the second V-fold segment.

3. The inflatable drop-stitch structure having a non-planar surface contour of claim 1, further comprising a contour member between the first V-fold segment and the adjacent V-fold segment, wherein the contour member has a contour profile directed toward the second inward facing side and the contour profile forms a complimentary profile in the complimentary contour of the second surface.

4. The inflatable drop-stitch structure having a non-planar surface contour of claim 3, further comprising a top covering fixed over the V-fold.

5. The inflatable drop-stitch structure having a non-planar surface contour of claim 4, wherein the top covering assists in holding the first V-fold segment, contour member and second V-fold segment together.

6. The inflatable drop-stitch structure having a non-planar surface contour of claim 1, wherein the drop-stitch member has a front end and a rear end and a longitudinal axis between the front end and rear end, and wherein the V-fold in the first surface and the complimentary contour of the second surface forms a keel extending from the second outward surface along the longitudinal axis when the drop-stitch member is inflated and the plurality of threads are in tension.

7. A process for forming a non-planar surface contour in an inflatable drop-stitch structure comprising the steps of:

a. providing a drop-stitch member comprising a first surface having a first outward facing side and a first inward facing side, a second surface having a second outward facing side and a second inward facing side, wherein the first inward facing side and second inward facing side are opposed to each other, wherein the drop-stitch member further comprises a plurality of threads joined to the first inward facing side at a proximal thread end and joined to the second inward facing side at a distal thread end, wherein the plurality of threads holds the first surface at a fixed distance from the opposed second surface when inflated;

b. applying a glue strip to a glued portion of the outward facing side of the first surface; and c. folding the first outward facing side over and onto the first outward facing side along the glue strip, wherein the glue strip adheres the first outward facing side along the glued portion forming a V-fold in the first surface, wherein the V-fold extends from the first inward facing side toward the second inward facing side.

8. The process for forming a non-planar surface contour in an inflatable drop-stitch structure of claim 7, further comprising the step of adhering a top covering on the first outward facing side of the first surface over the glued portion of the V-fold.

9. The process for forming a non-planar surface contour in an inflatable drop-stitch structure of claim 7, further comprising the steps of:

a. providing a contour member having a contour profile; and b. placing the contour member in the glued portion of the V-fold and directing the contour profile toward the second inward facing side.

10. The process for forming a non-planar surface contour in an inflatable drop-stitch structure of claim 9, further comprising the step of adhering a top covering on the first outward facing side of the first surface over the glued portion of the V-fold.

11. The process for forming a non-planar surface contour in an inflatable drop-stitch structure of claim 10, wherein the top covering assists in holding the glued portion of the V-fold and contour member together.

12. The process for forming a non-planar surface contour in an inflatable drop-stitch structure of claim 11, wherein the contour profile causes a complimentary contour profile to form on the second outward facing surface when the drop-stitch member is inflated.

* * * * *